US009891552B2

(12) United States Patent
Suzumi et al.

(10) Patent No.: US 9,891,552 B2
(45) Date of Patent: Feb. 13, 2018

(54) IMAGE FORMING APPARATUS PERFORMING TONER PURGE PROCESSING

(71) Applicant: CANON KABUSHIKI KAISHA, Tokyo (JP)

(72) Inventors: Masahiko Suzumi, Yokohama (JP); Tomoo Akizuki, Kawasaki (JP); Jun Hara, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/179,451

(22) Filed: Jun. 10, 2016

(65) Prior Publication Data

US 2016/0370745 A1 Dec. 22, 2016

(30) Foreign Application Priority Data

Jun. 19, 2015 (JP) ..... 2015-124116

(51) Int. Cl.

| | |
|---|---|
| ***G03G 21/18*** | (2006.01) |
| ***G03G 15/08*** | (2006.01) |
| ***G03G 15/00*** | (2006.01) |
| ***G03G 21/00*** | (2006.01) |
| *G03G 21/20* | (2006.01) |

(52) U.S. Cl.

CPC ..... *G03G 15/0822* (2013.01); *G03G 15/55* (2013.01); *G03G 21/0005* (2013.01); *G03G 21/1828* (2013.01); *G03G 21/1889* (2013.01); *G03G 15/0844* (2013.01); *G03G 21/203* (2013.01)

(58) Field of Classification Search

CPC .. G03G 15/50; G03G 21/203; G03G 15/0844; G03G 21/1828

See application file for complete search history.

(56) References Cited

U.S. PATENT DOCUMENTS

| | | | | |
|---|---|---|---|---|
| 8,855,513 | B2 * | 10/2014 | Murakami | G03G 15/161 399/44 |
| 2003/0063928 | A1 * | 4/2003 | Matsuguma | G03G 15/01 399/299 |
| 2009/0190946 | A1 * | 7/2009 | Ai | G03G 15/161 399/66 |

(Continued)

FOREIGN PATENT DOCUMENTS

| | | |
|---|---|---|
| JP | 2004-191737 A | 7/2004 |
| JP | 2005-099215 A | 4/2005 |

(Continued)

*Primary Examiner* — David M Gray
*Assistant Examiner* — Laura Roth
(74) *Attorney, Agent, or Firm* — Fitzpatrick, Cella, Harper & Scinto

(57) ABSTRACT

The image forming apparatus prevents a transfer roller from slipping when discharge processing for supplying toner to a contact portion between a photosensitive drum and a cleaning blade is performed. The developing unit performs transfer operation to form band-like toner images on a photosensitive drum to supply a predetermined amount of toner to a contact portion between the photosensitive drum and a cleaning blade without causing the transfer roller to perform transfer operation, so that the predetermined amount of toner is supplied in a plurality of batches.

10 Claims, 6 Drawing Sheets

(56) References Cited

U.S. PATENT DOCUMENTS

| | | | | |
|---|---|---|---|---|
| 2009/0190950 | A1* | 7/2009 | Ai | G03G 15/161 399/101 |
| 2009/0190951 | A1* | 7/2009 | Torimaru | G03G 15/161 399/101 |
| 2015/0093130 | A1* | 4/2015 | Kikuchi | G03G 15/80 399/46 |

FOREIGN PATENT DOCUMENTS

| | | | |
|---|---|---|---|
| JP | 2010-122468 | A | 6/2010 |
| JP | 2011-128316 | A | 6/2011 |

* cited by examiner

IMAGE FORMING APPARATUS PERFORMING TONER PURGE PROCESSING

BACKGROUND OF THE INVENTION

Field of the Invention

The present invention relates to an image forming apparatus using an electrophotographic method or an electrostatic recording method.

Description of the Related Art

Conventionally, image forming apparatuses such as copiers, printers and facsimile apparatuses using an electrophotographic method or an electrostatic recording method have been known. In such image forming apparatuses, a toner image formed on a photosensitive drum is transferred by a transfer roller onto a recording material (e.g., paper) that is being conveyed, whereby an image is formed. Here, on a surface of the photosensitive drum, some toner remains without being transferred. Thus, a technique including a cleaning blade made of an elastic member, the cleaning blade scraping off toner remaining on a photosensitive drum (remaining toner) is known.

The cleaning blade includes a sharp edge at a tip thereof provided in pressure contact with the surface of the photosensitive drum on the downstream side relative to a transfer site in a direction of rotation of the photosensitive drum to scrape remaining toner off. Thus, a large friction force may be generated between the edge at the tip of the cleaning blade and the photosensitive drum. In other words, if there is a certain amount of toner in a contact portion between the cleaning blade and the photosensitive drum, the toner or an external additive in the toner functions as a lubricant, and thus, only a small friction force is generated. However, if there is no or only a small amount of toner in the contact portion, a large friction force is generated between the edge at the tip of the cleaning blade and the photosensitive drum. Consequently, problems such as bur formation and stick-slip in the cleaning blade are likely to occur. In particular, if the photosensitive drum is a new one, there is no toner in the contact portion between the cleaning blade and the photosensitive drum and thus such problems are more likely to occur.

In order to solve such problems, Japanese Patent Application Laid-Open No. 2004-191737 discloses a technique in which toner is supplied to a contact portion between a cleaning blade and a photosensitive drum when no image formation is performed.

In general, a transfer roller is often configured so as to be rotated to follow a photosensitive drum. In this case, if a friction force between the transfer roller and the photosensitive drum is excessively low, the transfer roller slips. When processing for supplying toner to a contact portion between a cleaning blade and the photosensitive drum is performed during no image formation being performed as mentioned above, the toner passes through between the photosensitive drum and the transfer roller. Thus, the amount of toner between the photosensitive drum and the transfer roller becomes large, and the friction force between the photosensitive drum and the transfer roller thereby becomes excessively low, which may result in slippage of the transfer roller. If the transfer roller slips, a part of the transfer roller takes a scraping of the toner and the transfer roller remains in a state in which toner adheres thereto. In this case, in subsequent image formation operation, the problem of toner adhering to a back surface of a recording material such as paper occurs.

As a countermeasure for this problem, it is possible to, when processing for supplying toner to a contact portion between a cleaning blade and a photosensitive drum, reduce a thickness of toner formed on the photosensitive drum to reduce the toner amount. However, because of variations in, e.g., output of high-voltage power supply such as a developing bias and sensitivity of the photosensitive drum, it is very difficult to control the toner amount so as to prevent both transfer roller slippage and cleaning blade bur formation. It is also possible to prevent slippage of the transfer roller by driving the transfer roller itself to rotate. However, e.g., a driving gear is required to drive the transfer roller, resulting in increase in cost of the apparatus.

SUMMARY OF THE INVENTION

An object of the present invention is to provide an image forming apparatus that suppresses slippage of a transfer roller when toner supply processing for supplying toner to a contact portion between a photosensitive drum and a cleaning blade.

Another object of the present invention is to provide an image forming apparatus including a photosensitive drum configured to form an electrostatic latent image on the photosensitive drum, a developing unit configured to develop the electrostatic latent image formed on the photosensitive drum, with toner, a transfer roller configured to transfer the toner image developed by the developing unit onto a recording material that is being conveyed, a collecting member that is in contact with the photosensitive drum and collects toner from the photosensitive drum, and a control unit that performs discharge processing of causing the developing unit to form a plurality of band-like toner images extending in an axial direction of the photosensitive drum on the photosensitive drum and supplying the plurality of band-like toner images to the contact portion between the photosensitive drum and the collecting member, wherein in the discharge processing performed once, a total amount of the plurality of band-like toner images is a predetermined amount.

Further features of the present invention will become apparent from the following description of exemplary embodiments with reference to the attached drawings.

DESCRIPTION OF THE EMBODIMENTS

Exemplary embodiments of the present invention will be described in detail below with reference to the drawings. However, the dimensions, materials and shapes of the components and the relative arrangement of the components described in these exemplary embodiments are not intended to limit the scope of the present invention thereto unless otherwise specifically stated.

(Exemplary Embodiment 1)

Figure 1:
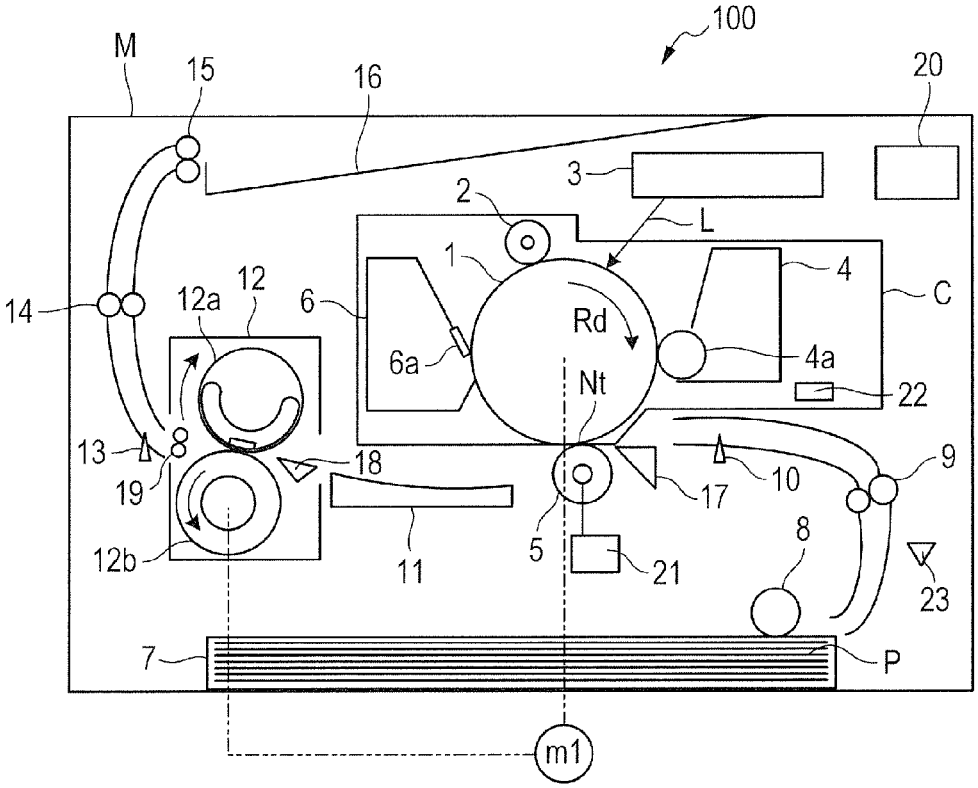
FIG. 1 is a schematic vertical cross-sectional view of an image forming apparatus according to an exemplary embodiment of the present invention.

An image forming apparatus according to exemplary embodiment 1 of the present invention will be described with reference to FIGS. 1 to 3. The present exemplary embodiment will be described taking an electrophotographic laser printer as an example of an image forming apparatus.

<Overall Configuration and Operation of Image Forming Apparatus>

In particular, an overall configuration and operation of an image forming apparatus according to the present exemplary embodiment will be described with reference to FIG. 1. FIG. 1 is a schematic vertical cross-sectional view of an image forming apparatus according to an exemplary embodiment of the present invention, which illustrates a schematic configuration in cross section.

An image forming apparatus 100 includes a photosensitive drum 1, which is a drum-shaped (cylindrical) electrophotographic sensitive body, as an image bearing member. The photosensitive drum 1 is configured by providing a photosensitive material such as organic photo-semiconductor (OPC), amorphous selenium or amorphous silicon on a cylindrical drum base body formed of, e.g., aluminum or nickel. The photosensitive drum 1 is rotatably supported by an image forming apparatus body (hereinafter referred to as "apparatus body M"), and is driven to rotate at a process speed (circumferential speed) of 230 mm/second in the arrow R direction in the figure by a main motor ml, which is a drive source. In the present exemplary embodiment, an outer diameter of the photosensitive drum 1 is 24 mm.

The photosensitive drum 1 is driven to rotate in the arrow Rd direction in the figure by the main motor ml. A surface of the rotating photosensitive drum 1 is substantially uniformly charged so as to have a predetermined potential of a predetermined polarity (negative polarity in the present exemplary embodiment) by a charge roller 2 (primary charging). Here, a charge bias (charge voltage) is applied to the charge roller 2 from a non-illustrated charge power supply (high-voltage power supply). The charged surface of the photosensitive drum 1 is subjected to image exposure L based on image information by an exposure device (laser optical system) 3, and charge in exposed parts is eliminated, whereby an electrostatic latent image (electrostatic image) is formed. The electrostatic latent image formed on the photosensitive drum 1 is developed as a toner image by a developing unit 4. The developing unit 4 includes a developing roller 4*a*, which serves as a deceloper bearing member that supplies toner to a part (developing part) facing the photosensitive drum 1. Then, a developing bias (developing voltage) is applied from a non-illustrated developing power supply (high-voltage power supply) to the developing roller 4*a* and then toner adheres to the electrostatic latent image on the photosensitive drum 1, whereby the toner image is developed out. In the present exemplary embodiment, a toner image is formed using a reversal development method in which toner charged so as to have a polarity that is the same as a charge polarity of the photosensitive drum 1 is made to adhere to an exposed part having a potential whose absolute value has been lowered as a result of uniform charging followed by exposure.

The toner image formed on the photosensitive drum 1 is transferred onto a recording material, such as paper, that is being conveyed, by action of the transfer roller 5. The transfer roller 5 is biased (pressed) against the photosensitive drum 1 by a non-illustrated transfer pressure spring and is thereby in pressure contact with the photosensitive drum 1. Consequently, a transfer nipper (transfer nipping part) Nt is formed at a contact portion between the photosensitive drum 1 and the transfer roller 5. The transfer roller 5 is configured so as to be rotated to follow the photosensitive drum 1. In other words, the transfer roller 5 includes no mechanism that drives the transfer roller 5 itself, and is configured so as to, upon rotation of the photosensitive drum 1, also rotate by means of a force of friction against the photosensitive drum 1. In the present exemplary embodiment, an outer diameter of the transfer roller 5 is 12.5 mm. The transfer roller 5 nips and conveys a recording material P jointly with the photosensitive drum 1 therebetween. Here, a transfer bias (transfer voltage), which is a direct-current voltage having a polarity that is opposite of the charge polarity of the toner at the time of development (regular charge polarity), is applied to the transfer roller 5 from a transfer power supply (high-voltage power supply) 21. Consequently, the toner image on the photosensitive drum 1 is transferred to a predetermined position on the recording material P.

The recording materials P are stored in a recording material cassette 7 and are fed out one by one by a feed roller 8, and further conveyed downstream by conveying rollers 9 and conveyed to a transfer nip Nt along a pre-transfer guide 17, which is a guide member. Here, a leading edge of each recording material P is detected by a top sensor 10 and the recording material P is then synchronized with a toner image on the photosensitive drum 1. The recording material P with the toner image transferred thereon is conveyed to a fixing device 12 along a conveying guide 11 and the unfixed toner image is heated and pressured and is thereby fixed to a surface of the recording material P. Here, the fixing device 12 includes a heating body 12*a* and a pressure member 12*b*, a fixing entrance guide roller 18 that guides the recording material P to the fixing device 12, and fixing exit guide rollers 19.

The recording material P with the toner image fixed thereto by the fixing device 12 is conveyed further downward by conveying rollers 14 and then output onto a discharge tray 16 formed at an upper surface of the apparatus body M in the figure, by discharge rollers 15. Here, for example, for confirmation of whether or not a jam (paper jam) has occurred, a trailing edge of the recording material P is detected by an output sensor 13. In the present exemplary embodiment, during successive printing on recording materials, the recording materials are output with a spacing (paper interval) of 12 mm between the respective recording materials on a conveying path at a print speed of 47 sheets per minute.

Here, after transfer, toner remaining without being transferred to the recording materials P by the transfer roller 5 (transfer residual toner) sometimes adheres to the surface of the photosensitive drum 1. The transfer residual toner is removed by a collecting member made of an elastic member in a cleaning device 6. The collecting member is a cleaning blade 6*a* having a blade shape. The cleaning blade 6*a* includes an elastic member such as a member formed of urethane rubber. The cleaning blade 6*a* includes a sharp edge at a tip thereof provided in pressure contact with the surface of the photosensitive drum 1 on the downstream side relative to a transfer site in a direction of rotation of the photosensitive drum 1 to scrape remaining toner off.

Repetition of the above operation enables sequential image formation. In the present exemplary embodiment, a process cartridge C configured so as to be attachable/detachable to/from the apparatus body M is provided. The process cartridge C includes the photosensitive drum 1, the charge roller 2, the developing unit 4 and the cleaning device 6, which have been described above. Therefore, if toner stored in the developing unit 4 is gone, the process cartridge C may be replaced with a new process cartridge C. Also, in the image forming apparatus 100, an environmental sensor 23 that detects a temperature and a humidity can be provided. Consequently, respective operations for image formation can be controlled according to a temperature and a humidity.

The image forming apparatus 100 according to the present exemplary embodiment is configured so as to, in order to prevent, e.g., burr formation in a cleaning blade 6*a*, perform processing for supplying toner to a contact portion between the cleaning blade 6*a* and the photosensitive drum 1 during no image being formed (discharge processing). Hereinafter, for sake of simplicity, such toner supply processing is referred to as "toner purge processing". In toner purge processing, generally, first, a band-like toner image is formed on the photosensitive drum 1 by the developing unit 4. Here, "band-like toner image" means a toner image extending like a belt in a rotation center axis of the photosensitive drum 1. Then, a predetermined amount of toner is supplied to the contact portion between the photosensitive drum 1 and the cleaning blade 6*a* without transfer operation being performed by the transfer roller 5. The toner purge processing will be described in more detail below.

<Toner Purge Processing>

As stated in the Background Art section, where there is no or only a small amount of toner in a contact portion between a cleaning blade and a photosensitive drum, e.g., a bur is likely to be formed on the cleaning blade. In particular, if the photosensitive drum is a new one, there is no toner in the contact portion between the cleaning blade and the photosensitive drum, and thus, e.g., a bur is likely to be formed on the cleaning blade. Therefore, in the present exemplary embodiment, a case where the process cartridge C including the photosensitive drum 1 is a new one and toner purge processing is performed at a stage of initial use will be described.

In the process cartridge C, a memory 22 that enables use information indicating that the process cartridge C is a new one to be input thereto is provided. As the use information, for example, time of driving of the process cartridge C is stored in the memory 22 from a controller 20, which is a control device. The controller 20 can determine that the process cartridge C is at a stage of initial use if the driving time does not reach a predetermined period of time (for example, one hour). Here, "initial use" includes first use of a new process cartridge C and use of the new process cartridge C within the predetermined period of time.

Then, when the image forming apparatus 100 starts operation, the controller 20 accesses the memory 22 in the process cartridge C to determine whether or not the process cartridge C is at a stage of "initial use". If the controller 20 determines that the process cartridge C is at a stage of "initial use", the controller 20 causes toner purge processing to be performed.

Next, basic operation in the toner purge processing will be described. The controller 20 causes a developing bias to be applied to the developing roller 4*a* to form a band-like toner image on the photosensitive drum 1. Then, the controller 20 causes the toner image formed as described above to supply onto the contact portion between the photosensitive drum 1 and the cleaning blade 6*a* without causing the transfer roller 5 to perform transfer operation (that is, without the toner image being transferred onto a recording material).

In the toner purge processing according to the present exemplary embodiment, the controller 20 causes a band-like toner image to be formed on the photosensitive drum 1 by application of only a developing bias to the developing roller 4*a* without charging and exposing the photosensitive drum 1. In other words, in a state in which no primary charging is performed by the charge roller 2, a potential of the surface of the photosensitive drum 1 is a potential that is equivalent to a potential resulting from charging via the charge roller 2 and exposure via an exposure device 3. In other words, the surface of the photosensitive drum 1 is in a state that is similar to that of a case where an electrostatic latent image is formed. Therefore, application of only a developing bias to the developing roller 4*a* enables formation of a band-like toner image on the photosensitive drum 1. In the toner purge processing according to the present exemplary embodiment, for the developing bias applied to the developing roller 4*a*, a developing bias that is the same as that used for image formation (developing bias obtained by superimposition of AC components (an amplitude Vpp and a frequency f) on DC components (Vdc)) is used. In the present exemplary embodiment, settings are made so that Vdc=−350 V, Vpp=1.4 kV and f=2.1 kHz.

Although in the present exemplary embodiment, only a developing bias is applied to perform toner purge processing, without applying a charge bias, a method of the toner purge processing in the present invention is not limited to this. In other words, when toner purge processing is performed, a band-like toner image may be formed by the developing unit 4 after the photosensitive drum 1 being charged by the charge roller 2 and subsequently exposed by the exposure device 3 to form an electrostatic latent image having a band shape of a predetermined width. As described above, a charge bias, an exposure condition and a developing bias in toner purge processing can arbitrarily be set. Also, in the present exemplary embodiment, a process speed in toner purge processing is set to be half of a speed in image formation (process speed of 115 mm/s).

Next, a more specific example of the toner purge processing according to the present exemplary embodiment will be described with reference to the flowchart in FIG. 2 and the timing chart in FIG. 3. In FIGS. 2 and 3, for sake of simplicity, respective states are expressed as follows. A state in which the main motor ml is driven is expressed as "MAIN MOTOR ON", and a state in which the main motor ml is not driven is expressed as "MAIN MOTOR OFF". Also, a state in which a developing bias is applied to the developing roller 4*a* is expressed as "DEVELOPING BIAS ON" and a state in which no developing bias is applied to the developing roller 4*a* is expressed as "DEVELOPING BIAS OFF". Furthermore, a state in which a negative transfer bias having a polarity that is the same as that of toner is applied to the transfer roller 5 is expressed as "TRANSFER BIAS (−) ON" and a state in which no transfer bias is applied to the transfer roller 5 is expressed as "TRANSFER BIAS (−) OFF".

Upon the process cartridge C being attached to the image forming apparatus 100, the controller 20 reads information in the memory 22 (Step 101) and determines whether or not the process cartridge C is at a stage of "initial use" (Step 102). If it is determined in Step 102 that the process cartridge C is not at a stage of "initial use", processing for a case of normal process cartridge attachment is performed, and the image forming apparatus 100 enters a ready state (image formation readiness state). Here, examples of "processing for a case of normal process cartridge attachment" include cleaning processing for the photosensitive drum 1 and the transfer roller 5.

If it is determined in Step 102 that the process cartridge C is at a stage of "initial use", the above-described toner purge processing is performed. In other words, the controller 20 starts driving of the main motor m1 (Step 103). Subsequently, the controller 20 causes a developing bias to be applied to the developing roller 4*a* to form a band-like toner image on the photosensitive drum 1, and also applies a transfer bias to the transfer roller 5 (Step 104). Here, when the toner image formed on the photosensitive drum 1 passes by the transfer roller 5, the transfer bias having a polarity that is the same as that of toner is applied to the transfer roller 5. Consequently, the band-like toner image formed on the photosensitive drum 1 can be prevented from being attracted by the transfer roller 5. Next, the controller 20 causes a necessary toner image (corresponding to an application duration of 300 ms and a toner band width of 35 mm in the present exemplary embodiment) to be formed on the photosensitive drum 1 and then ceases the application of the developing bias (Step 105). Here, in a conventional toner purge processing operation, a toner image having a width of approximately 70 mm exceeding a rotation length (approximately 40 mm) of the transfer roller is formed.

Next, with the application of the developing bias ceased for a period of time corresponding to one rotation of the transfer roller, the controller 20 continues the application of the negative bias to the transfer roller 5 (Steps 105 and 106). Consequently, a part of a surface of the transfer roller 5 that was brought into contact with the toner image on the photosensitive drum 1 is cleaned off. Subsequently, the controller 20 causes the developing bias to be applied again (Step 106) to form a necessary toner image (corresponding to an application duration of 300 ms and a toner band width of 35 mm in the present exemplary embodiment), and then stops the application of the developing bias (Step 107). Subsequently, the controller stops the application of the transfer bias to the transfer roller 5 (Step 108) and stops the driving of the main motor (Step 109). Through the above process, the toner purge processing ends and the image forming apparatus 100 enters a ready state.

As described above, in the image forming apparatus 100 according to the present exemplary embodiment, when toner purge processing is performed, the controller 20 causes a predetermined amount of toner to be supplied in a plurality of batches (two batches in the present exemplary embodiment). More specifically, the controller 20 causes a developing bias to be applied intermittently to the developing roller 4*a*, whereby a predetermined amount of toner is supplied in a plurality of batches (two batches in the present exemplary embodiment). Also, the controller 20 causes cleaning processing for cleaning the surface of the transfer roller 5 to be performed within a period of time in which toner purge processing is performed. The "cleaning processing" is processing in which the surface of the transfer roller 5 is brought into contact with a region of the surface of the photosensitive drum 1 on which no toner image is formed, with a bias having a polarity that is the same as that of toner applied to the transfer roller 5. In the present exemplary embodiment, as described above, cleaning processing is performed by the controller 20 continuing the application of the negative bias to the transfer roller 5 while ceasing the application of the developing bias for a period of time corresponding to one rotation of the transfer roller (Steps 105 to 106). Then, in the present exemplary embodiment, a part of the surface of the transfer roller 5 that was brought into contact with the band-like toner image is prevented from being brought into contact with a toner image successively without being subjected to cleaning processing. In other words, this is achieved by the controller 20 controlling a timing for supplying toner and a timing for performing cleaning processing. In the case of the present exemplary embodiment, as described above, during toner purge processing, toner supply and cleaning processing are alternately performed, which is enabled by making a duration of cleaning processing be a period of time corresponding to no less than one rotation of the transfer roller 5.

<Advantages of the Image Forming Apparatus According to the Present Exemplary Embodiment>

As described above, in the image forming apparatus 100 according to the present exemplary embodiment, when the controller 20 causes toner purge processing to be performed, the controller 20 causes a predetermined amount of toner to be supplied in a plurality of batches (two batches in the present exemplary embodiment). Consequently, a predetermined necessary amount of toner can be supplied to the contact portion between the photosensitive drum 1 and the cleaning blade 6*a* while an amount of toner between the photosensitive drum 1 and the transfer roller 5 can be prevented from being large. Consequently, a force of friction between the photosensitive drum 1 and the transfer roller 5 is prevented from being excessively low, and thus slippage of the transfer roller 5 is suppressed. Therefore, a part of the transfer roller 5 taking a scrape of toner and the transfer roller 5 remaining with the toner adhering thereto are also suppressed. Thus, toner adhering to a back surface of the recording material P such as paper in subsequent image forming operation is suppressed.

Also, in the present exemplary embodiment, the controller 20 causes cleaning processing for cleaning the surface of the transfer roller 5 to be performed during a period in which toner purge processing is performed. Then, in the present exemplary embodiment, the part of the surface of the transfer roller 5 that was brought into contact with a band-like toner image is prevented from being brought into contact with a toner image successively without being subjected to cleaning processing. Accordingly, an amount of toner between the photosensitive drum 1 and the transfer roller 5 can effectively be prevented from being large.

Results of a test of comparison among a case where no toner purge processing is performed, a case where conventional toner purge processing is performed and a case where the toner purge processing according to the present exemplary embodiment is performed will be described below. The comparison test was performed in an environment in which the cleaning blade 6*a* easily has a burr and a back surface of the recording material P is easily spotted (a temperature of 15° C. and a humidity of 10%), using a new process cartridge C. Also, for determination of spots on a back surface of each recording material P, 10 Canon A4-size paper sheets, "Oce Red Label" (basis weight of 80 g/m$^2$) were successively subjected to printing. As a result of an evaluation test, in the case where no toner purge processing was performed, no spots were found on the back surface of the recording materials P, but formation of a bur on the cleaning blade 6*a* and stick-slip in the cleaning blade 6*a* occurred. Also, in the case where conventional toner purge processing was performed, neither burr formation nor stick-slip occurred in the cleaning blade 6*a*, but spots were found on the back surfaces of the recording materials P. On the other hand, in the case where the toner purge processing according to the present exemplary embodiment was performed, neither burr formation nor stick-slip occurred in the cleaning blade 6*a* and no spots were found on the back surfaces of the recording materials P.

(Exemplary Embodiment 2)

Figure 4:
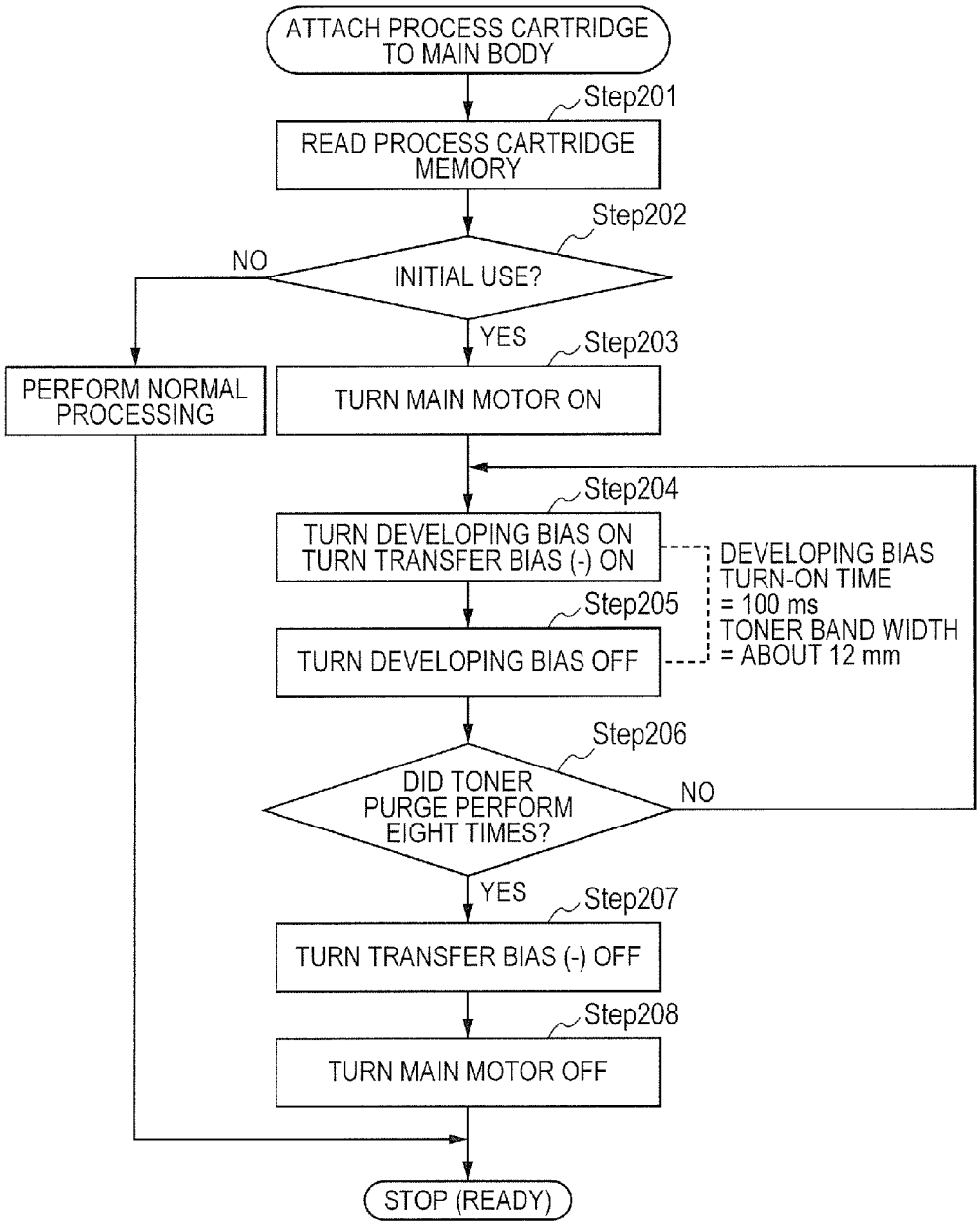
FIG. 4 is a flowchart illustrating toner purge processing operation in exemplary embodiment 2.
Figure 5:
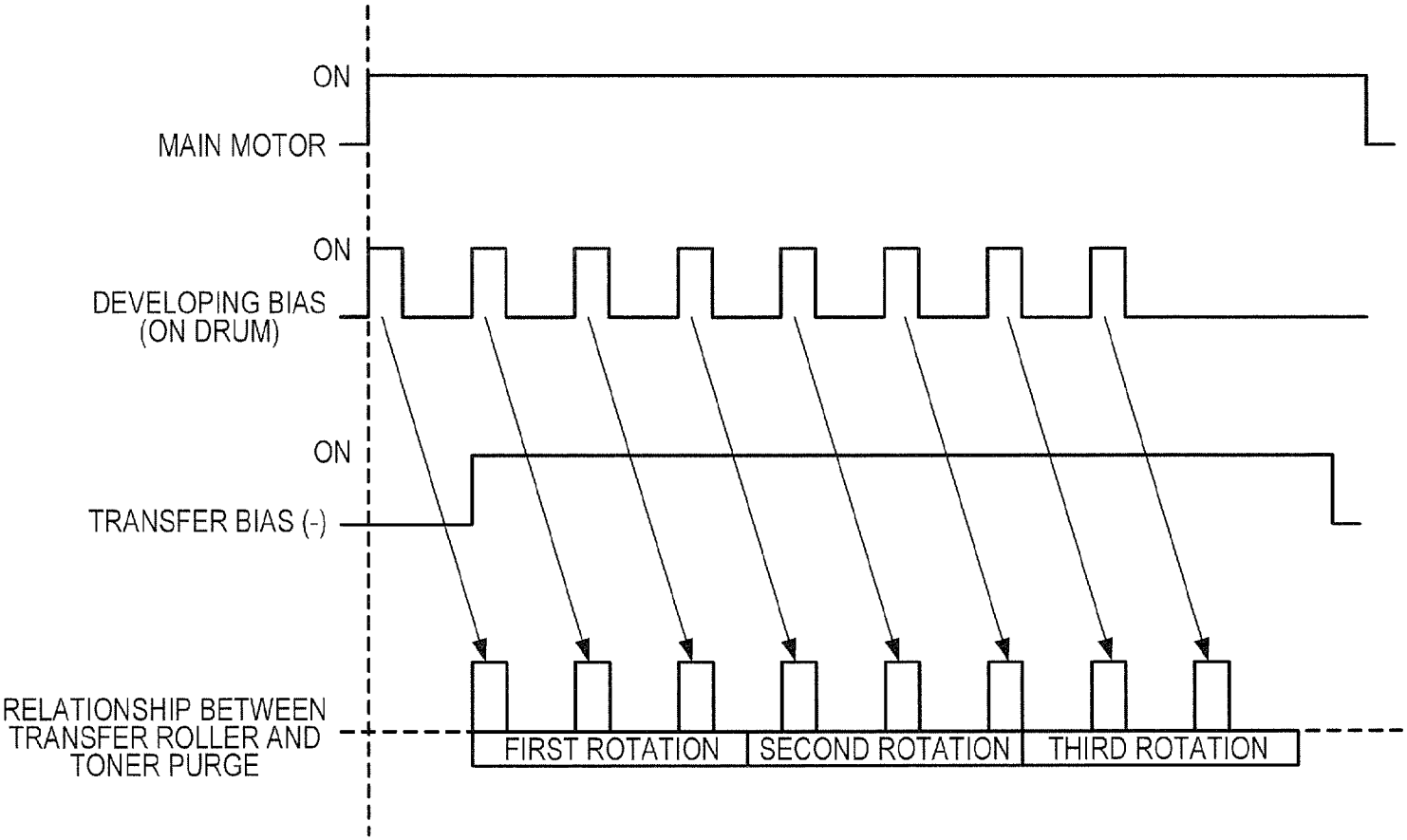
FIG. 5 is a timing chart illustrating the toner purge processing operation in exemplary embodiment 2.

FIGS. 4 and 5 illustrate exemplary embodiment 2 of the present invention. While exemplary embodiment 1 described above indicates the configuration in which a predetermined amount of toner is supplied in two batches in toner purge processing, the present exemplary embodiment indicates a configuration in which a predetermined amount of toner is supplied eight batches. Also, exemplary embodiment 1 described above indicates a configuration in which control is performed so that a period in which cleaning processing is performed is no less than a period of time required for one rotation of the transfer roller. This configuration enables a part of a surface of the transfer roller that was brought into contact with a band-like toner image to be prevented from being brought into a toner image successively without being subjected to cleaning processing. On the other hand, the present exemplary embodiment indicates a configuration in which in an arbitrary period corresponding to two rotations of a transfer roller during toner supply processing, a position in a surface of the transfer roller toner is brought into contact with in the first rotation of the transfer roller and a position in a surface of the transfer roller toner is brought into contact with toner in the second rotation of the transfer roller are different from each other. This configuration also enables a part of the surface of the transfer roller that was brought into contact with a band-like toner image to be prevented from being brought into contact with a toner image successively without being subjected to cleaning processing.

A configuration and operation of exemplary embodiment 2 is the same as that of exemplary embodiment 1 except a configuration relating to control of a timing for supplying toner and a timing for performing cleaning processing, and thus description thereof will arbitrarily be omitted. Therefore, an overall configuration, etc., of the image forming apparatus 100 is as described in exemplary embodiment 1, and thus, description thereof will be omitted.

Toner purge processing according to the present exemplary embodiment will be described with reference to the flowchart in FIG. 4 and the timing chart in FIG. 5. In FIGS. 4 and 5, for sake of simplicity, respective states are expressed as follows. A state in which a main motor ml is driven is expressed as "MAIN MOTOR ON", and a state in which the main motor ml is not driven is expressed as "MAIN MOTOR OFF". Also, a state in which a developing bias is applied to a developing roller 4*a* is expressed as "DEVELOPING BIAS ON", and a state in which no developing bias is applied to the developing roller 4*a* is expressed as "DEVELOPING BIAS OFF". Furthermore, a state in which a negative transfer bias having a polarity that is the same as that of toner is applied to a transfer roller 5 is expressed as "TRANSFER BIAS (–) ON", and a state in which no transfer bias is applied to the transfer roller 5 is referred to as "TRANSFER BIAS (–) OFF".

Upon a process cartridge C being attached to an image forming apparatus 100, a controller 20 reads information in a memory 22 (Step 201) and determines whether or not the process cartridge C is at a stage of "initial use" (Step 202). If it is determined in Step 202 that the process cartridge C is not at a stage of "initial use", processing for a case of normal process cartridge attachment is performed, and the image forming apparatus 100 enters a ready state (image formation readiness state). Here, examples of "processing for a case of normal process cartridge attachment" include cleaning processing for a photosensitive drum 1 and the transfer roller 5.

If it is determined in Step 202 that the process cartridge C is at a stage of "initial use", the above-described toner purge processing is performed. In other words, the controller 20 starts driving of the main motor m1 (Step 203). Subsequently, the controller 20 causes a developing bias to be applied to the developing roller 4*a* to form a band-like toner image on the photosensitive drum 1 and also applies a transfer bias to the transfer roller 5 (Step 204). Here, the application of the transfer bias having a polarity that is the same as that of toner to the transfer roller 5 enables the band-like toner image formed on the photosensitive drum 1 to be prevented from being attracted by the transfer roller 5. Next, the controller 20 causes a necessary toner image (corresponding to an application duration of 100 ms and a toner band width of 12 mm in the present exemplary embodiment) to be formed on the photosensitive drum 1 and then ceases the application of the developing bias (Step 205).

Next, the controller 20 determines whether or not the operations in Steps 204 and 205 (for sake of simplicity, expressed as "TONER PURGE" in FIG. 4) have been performed eight times (Step 206). If it is determined in Step 206 that the operation has not been performed eight times, the controller 20 causes the processing in Steps 204 and 205 to be performed. Then, if it is determined in Step 206 that the operation has been performed eight times, the controller 20 stops the application of the transfer bias to the transfer roller 5 (Step 207) and stops the driving of the main motor (Step 208). Through the above process, the toner purge processing ends and the image forming apparatus 100 enters a ready state.

As described above, in the image forming apparatus 100 according to the present exemplary embodiment, also, the controller 20 causes a predetermined amount of toner to be supplied in a plurality of batches (eight batches in the present exemplary embodiment) when performing toner purge processing. Also, in the present exemplary embodiment the controller 20 causes cleaning processing for cleaning a surface of the transfer roller 5 to be performed within a period in which toner purge processing is performed. The "cleaning processing" is as described in exemplary embodiment 1 above. In the present exemplary embodiment, toner is intermittently supplied in three batches for one rotation of the transfer roller (corresponding to a duration of the transfer roller 5 rotating once). Then, during intervals in which no toner is supplied, cleaning processing is performed. In other words, during these intervals, the controller 20 causes the negative bias to be continuously applied to the transfer roller 5 with the application of the developing bias ceased, whereby cleaning processing is performed. In the present exemplary embodiment, a part of the surface of the transfer roller 5 that was brought into contact with a band-like toner image is prevented from being brought into contact with a toner image successively without being subjected to cleaning processing. In other words, this is achieved by the controller 20 controlling a timing for supplying toner and a timing for performing cleaning processing. More specifically, this is achieved by the following control. The control is performed so that in an arbitrary period corresponding to two rotations of the transfer roller 5 during toner supply processing, a position in a surface of the transfer roller 5 toner that is brought into contact with toner in a first rotation of the transfer roller 5, and a position in the surface of the transfer roller 5 toner that is brought into contact with toner in a second rotation of the transfer roller 5 are different from each other. For example, in "RELATIONSHIP BETWEEN TRANSFER ROLLER AND TONER PURGE" in FIG. 5, the control is performed so that a position in the surface of the transfer roller 5 toner that is brought into contact with toner in the first rotation is shifted to another position in the second rotation. Also, the control is performed so that the position brought into contact with toner in the second rotation is shifted to another position in the third rotation. The control is performed in such a manner as above in an arbitrary period corresponding to two other rotations.

As described above, the toner purge processing in the image forming apparatus 100 according to the present exemplary embodiment also enables provision of effects that are similar to those of exemplary embodiment 1. In the case of the present exemplary embodiment, the number of times of toner supply in toner purge processing is greater than that of exemplary embodiment 1, requiring a long time for toner purge processing. However, an amount of toner supplied each time is smaller than that of exemplary embodiment 1, enabling further prevention of an amount of toner between the photosensitive drum 1 and the transfer roller 5 from being large. In the present exemplary embodiment, also, as a result of an evaluation test such as described in exemplary embodiment 1 being conducted, neither burr formation nor stick-slip occurred in the cleaning blade 6*a*, and no spots were found on a back surface of each recording material P.

(Exemplary Embodiment 3)

Figure 6:
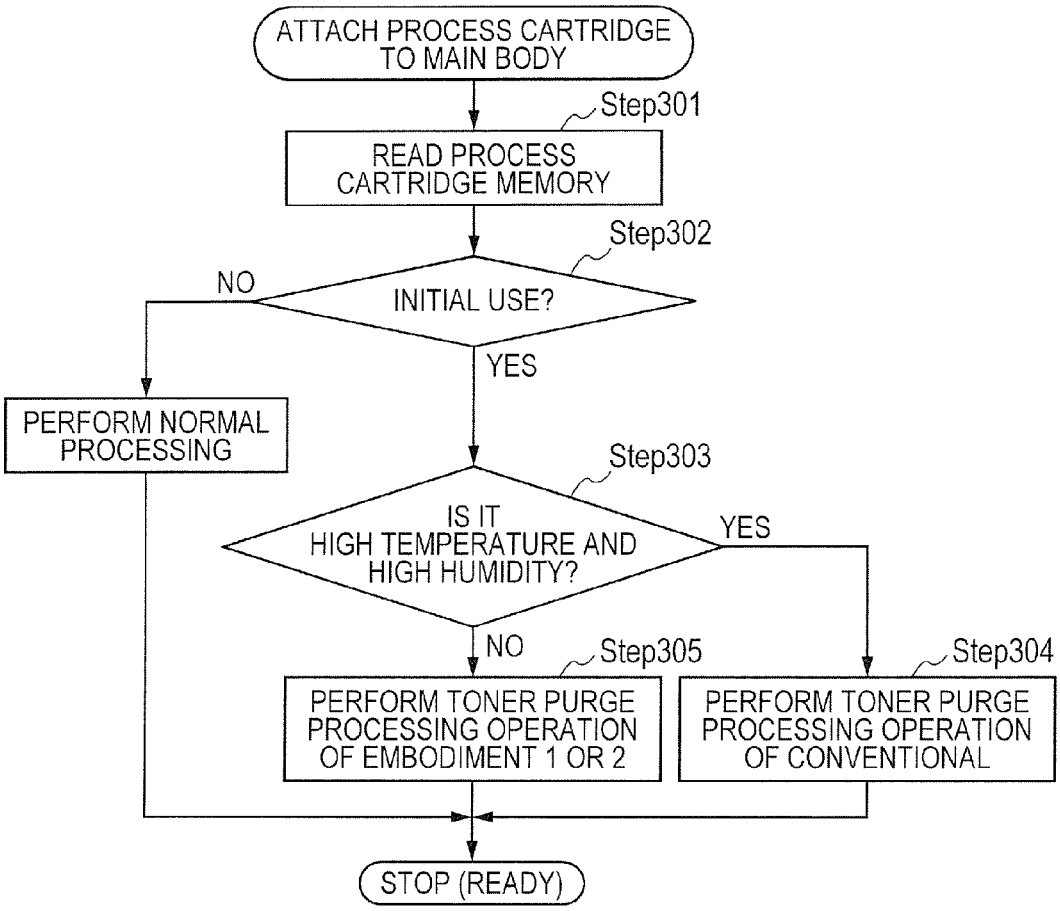
FIG. 6 is a flowchart illustrating toner purge processing operation in exemplary embodiment 3.

FIG. 6 illustrates exemplary embodiment 3 of the present invention. The present exemplary embodiment will be described in terms of a case where whether or not the toner purge processing indicated in exemplary embodiment 1 or 2 is performed or conventional normal toner purge processing is performed is determined according to a temperature and humidity environment. An overall configuration of an image forming apparatus and toner purge processing itself are as described above in the above exemplary embodiments, and thus description thereof will be omitted. However, although a configuration and operation of an image forming apparatus 100 according to the present exemplary embodiment is basically as described in exemplary embodiment 1, in the image forming apparatus 100 according to the present exemplary embodiment, an environmental sensor 23, which has been described in exemplary embodiment 1, is essential.

Slippage of a transfer roller easily occurs in a low-temperature, low-humidity environment of a temperature of around 15° C. and a humidity of around 10% and in a middle-temperature, middle-humidity environment of a temperature of around 23° C. and a humidity of around 50%, but rarely occurs in a high-temperature, high-humidity environment of a temperature of around 32° C. and a humidity of around 80%. This is because while a fluidity of toner is relatively high and a transfer roller thus easily slips in a low-temperature, low-humidity environment or a middle-temperature, middle-humidity environment, the fluidity of toner is low and a transfer roller does not slip in a high-temperature, high-humidity environment. Therefore, in a high-temperature, high-humidity environment, no particular problem occurs even if conventional toner purge processing is performed, rather than the toner purge processing indicated in exemplary embodiment 1 or 2. Therefore, the present exemplary embodiment will be described in terms of a case where control to determine whether or not the toner purge processing indicated in exemplary embodiment 1 or 2 is performed or conventional normal toner purge processing is performed according to a temperature and humidity environment.

In the present exemplary embodiment, the controller 20 is configured so as to be able to determine whether or not an environment is a high-temperature, high-humidity environment (a temperature is no less than a predetermined temperature and a humidity is no less than a predetermined humidity), based on detection data from an environmental sensor 23. A degree no less than which is deemed as a high temperature and a humidity no less than which is deemed as a high humidity can arbitrarily be determined according to, e.g., materials of a transfer roller 5 and toner. In the present exemplary embodiment, settings are made so that the controller 20 determines that an environment is a high-temperature, high-humidity environment in the case of, for example, a temperature of 32° C. and a humidity of 80%, and determines that an environment is not a high-temperature, high-humidity environment in the case of, for example, a temperature of 23° C. and a humidity of 50%.

Toner purge processing according to the present exemplary embodiment will be described with reference to the flowchart in FIG. 6.

Upon a process cartridge C being attached to the image forming apparatus 100, the controller 20 reads information in a memory 22 (Step 301) and determines whether or not the process cartridge C is at a stage of "initial use" (Step 302). If it is determined in Step 302 that the process cartridge C is not at a stage of "initial use", processing for a case of normal process cartridge attachment is performed and the image forming apparatus 100 enters a ready state (image forming readiness state). Here, examples of "processing for a case of normal process cartridge attachment" include cleaning processing of a photosensitive drum 1 and the transfer roller 5.

If it is determined in Step 302 that the process cartridge C is at a stage of "initial use", the controller determines whether or not an environment is a high-temperature, high-humidity environment, based on detection data from the environmental sensor 23 (Step 303). If it is determined in Step 303 that the environment is a high-temperature, high-humidity environment, the controller 20 causes conventional toner purge processing to be performed. In other words, the controller 20 causes a predetermined amount of toner to be supplied at a time when performing toner purge processing. On the other hand, if it is determined in Step 303 that the environment is not a high-temperature, high-humidity environment, the toner purge processing indicated in exemplary embodiment 1 or 2 is performed. In other words, the controller 20 causes a predetermined amount of toner to be supplied in a plurality of batches when performing toner purge processing. Here, the description "the toner purge processing according to exemplary embodiment 1 or 2 is performed" does not mean that either of the processes is selected, but means that a setting is made in advance to perform either one of the toner purge processes.

As described above, the toner purge processing in the image forming apparatus 100 according to the present exemplary embodiment enables provision of effects that are similar to those of exemplary embodiments 1 and 2. In other words, in an environment in which the transfer roller 5 may slip (an environment having neither a high temperature nor a high humidity), the toner purge processing according to exemplary embodiment 1 or 2 is performed, enabling provision of effects that are similar to those of exemplary embodiment 1 or 2. Then, in an environment in which the transfer roller 5 does not slip (high-temperature, high-humidity environment), conventional toner purge processing is performed, enabling reduction in time required for the toner purge processing. similar to those of exemplary embodiments 1 and 2. In (Others)

Figure 2:
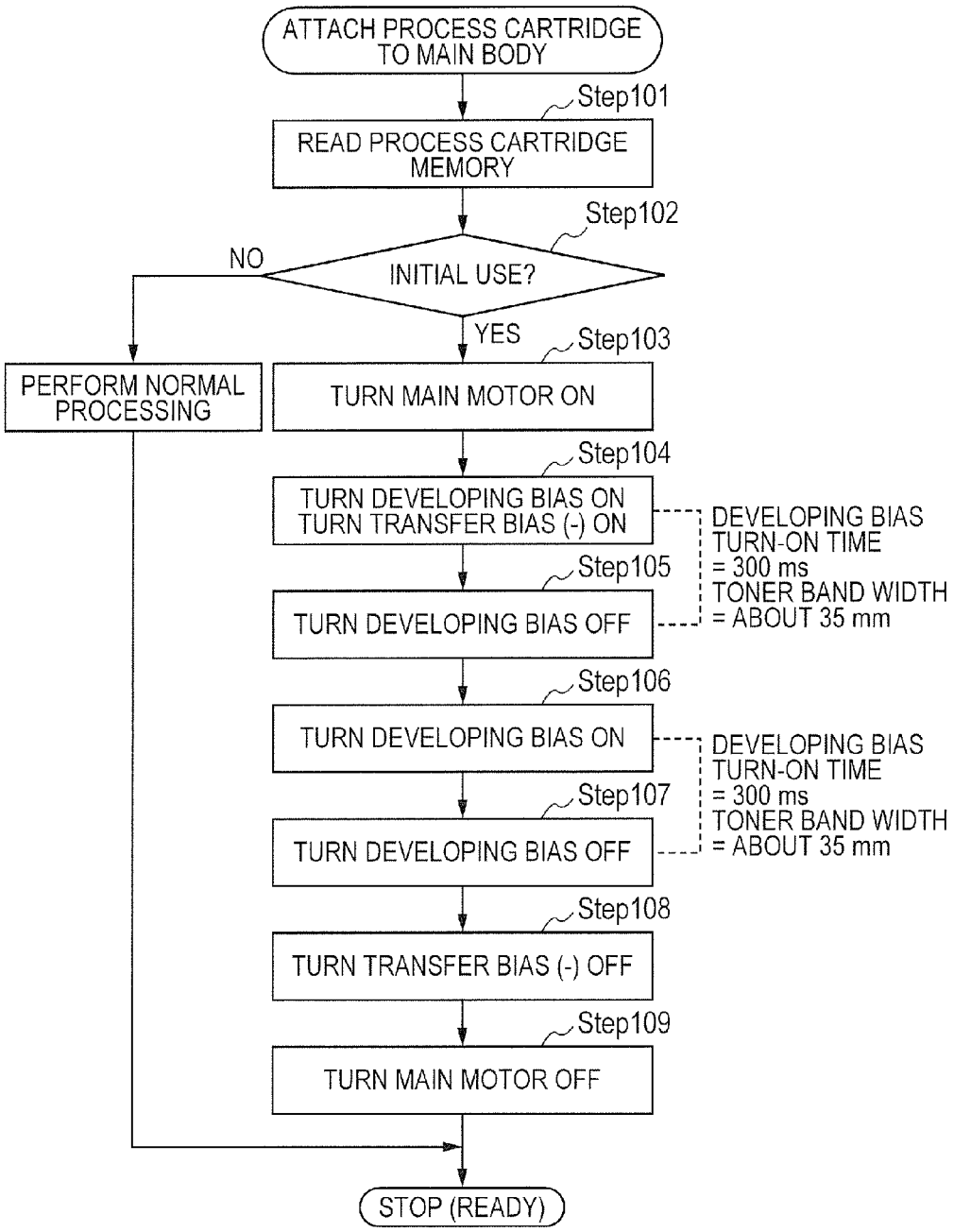
FIG. 2 is a flowchart illustrating toner purge processing operation in exemplary embodiment 1.
Figure 3:
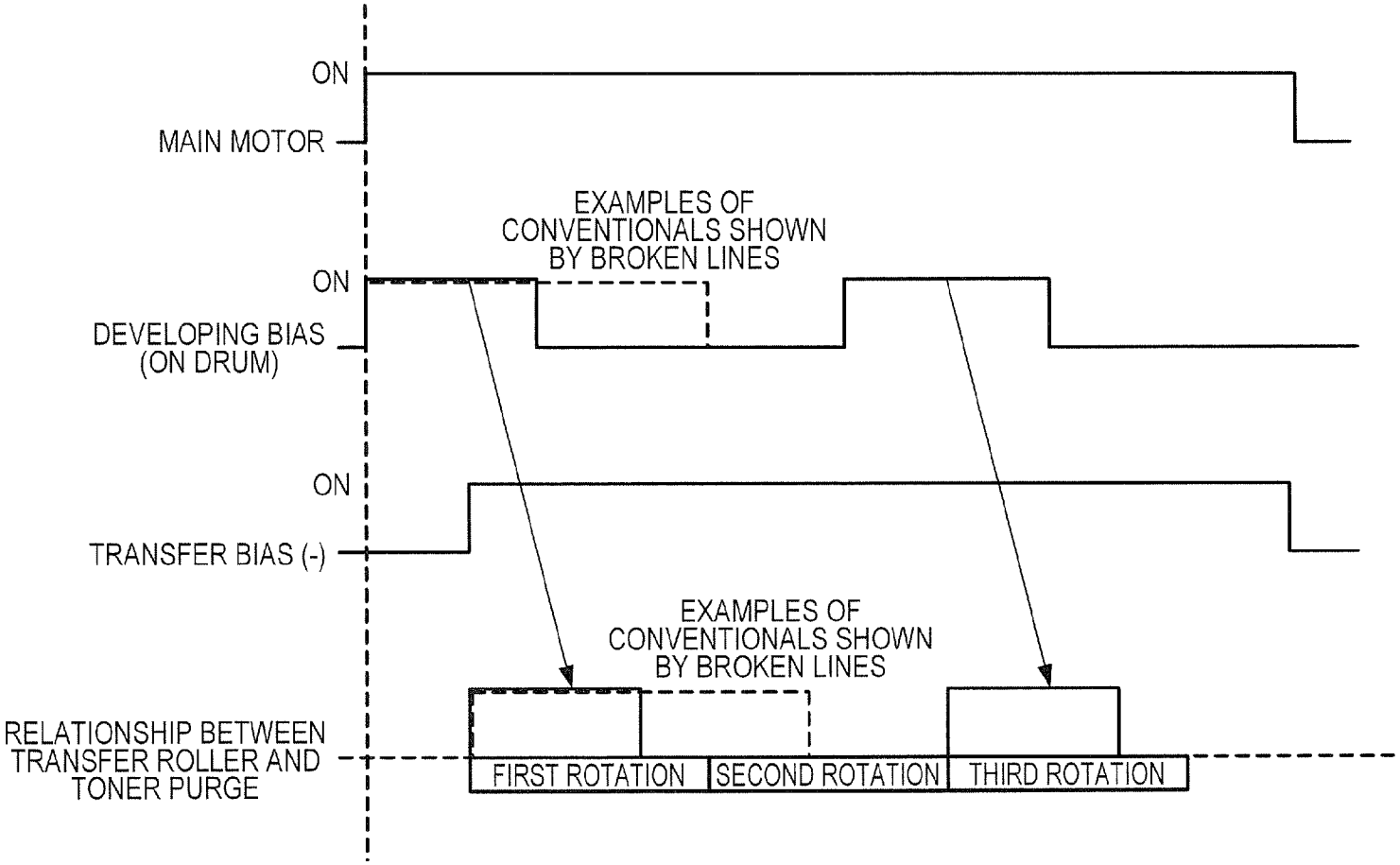
FIG. 3 is a timing chart illustrating the toner purge processing operation of exemplary embodiment 1.

Each of the above exemplary embodiments has been described taking a case where if it is determined that a process cartridge C is at a stage of "initial use", toner purge processing is performed, as an example (see Step 102 in FIG. 2, Step 202 in FIG. 4 and Step 303 in FIG. 6). However, a timing for performing toner purge processing is not limited to such case. For example, it is possible that the controller 20 determines whether or not the number of times of image forming operations (equal to the total number of recording materials P conveyed) after toner purge processing being performed reaches a predetermined number of times (recording materials), and causes toner purge processing to be performed at a point of time when the predetermined number is reached. The toner purge processing in this case may be the same as the toner purge processing performed at the time of "initial use" or an amount of toner to be supplied in the toner purge processing can be reduced relative to the case of toner purge processing performed at the time of "initial use". Also, a way of supplying toner (e.g., whether or not only a developing bias is applied) may be different between toner purge processing performed at the time of "initial use" and toner purge processing performed the second time onwards.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-124116, filed Jun. 19, 2015, which is hereby incorporated by reference herein in its entirety.

What is claimed is:

1. An image forming apparatus comprising:

a photosensitive drum configured to have an electrostatic latent image formed thereon;

a developing unit configured to develop with toner the electrostatic latent image formed on the photosensitive drum;

a transfer roller configured to transfer a toner image developed by the developing unit onto a recording material that is being conveyed;

a collecting member that is in contact with the photosensitive drum and collects toner from the photosensitive drum; and a control unit that performs discharge processing of causing the developing unit to form a plurality of band-like toner images extending in an axial direction of the photosensitive drum on the photosensitive drum and supplying the plurality of band-like toner images to a contact portion between the photosensitive drum and the collecting member, wherein in the discharge processing performed once, a total amount of the plurality of band-like toner images is a predetermined amount, wherein the transfer roller is rotated to follow the photosensitive drum, wherein when the band-like toner images formed on the photosensitive drum as a result of the discharge processing being performed pass by the transfer roller, a voltage having a polarity that is the same as that of the toner is applied to the transfer roller, and wherein the control unit controls a length in a direction of movement of the photosensitive drum of each of the plurality of band-like toner images to be shorter than a peripheral length of the transfer roller.

2. The image forming apparatus according to claim 1, wherein the control unit controls the transfer roller to rotate and follow the photosensitive drum with the voltage having a polarity that is the same as that of the toner applied to the transfer roller, for no less than a period of time corresponding to one rotation of the transfer roller after each of the plurality of band-like toner images passes by the transfer roller.

3. The image forming apparatus according to claim 1, wherein the developing unit includes a developing roller that upon a developing voltage being applied thereto, supplies toner to a surface of the photosensitive drum, and the control unit intermittently applies the developing voltage.

4. The image forming apparatus according to claim 1, wherein the photosensitive drum, the developing unit and the contact member are included in an integrated process cartridge attachable to and detachable from the image forming apparatus.

5. The image forming apparatus according to claim 4, wherein the control unit performs the discharge processing if the process cartridge is in a mint condition.

6. The image forming apparatus according to claim 1, further comprising an environmental detection unit that detects a temperature and a humidity, wherein the control unit performs the discharge processing only if the control unit determines, based on the environmental detection unit, that a temperature is lower than a predetermined temperature and a humidity is lower than a predetermined humidity.

7. The image forming apparatus according to claim 1, wherein the collecting member is an elastic member.

8. The image forming apparatus according to claim 1, wherein the plurality of band-like toner images includes first and second band-like toner images, wherein the control unit performs the discharge processing so that the developing unit does not form the second band-like toner image when time corresponding to one rotation of the transfer roller elapses from a time when the first band-like toner image is formed.

9. An image forming apparatus comprising:

a photosensitive drum configured to have an electrostatic latent image formed thereon;

a developing unit configured to develop with toner the electrostatic latent image formed on the photosensitive drum;

a transfer roller configured to transfer a toner image developed by the developing unit onto a recording material that is being conveyed;

a collecting member that is in contact with the photosensitive drum and collects toner from the photosensitive drum; and a control unit that performs discharge processing of causing the developing unit to form a plurality of band-like toner images extending in an axial direction of the photosensitive drum on the photosensitive drum and supplying the plurality of band-like toner images to a contact portion between the photosensitive drum and the collecting member, wherein in the discharge processing performed once, a total amount of the plurality of band-like toner images is a predetermined amount, and wherein the control unit controls a length in a direction of movement of the photosensitive drum of each of the plurality of band-like toner images to be shorter than a peripheral length of the transfer roller.

10. The image forming apparatus according to claim 9, wherein the plurality of band-like toner images includes first and second band-like toner images, wherein the control unit performs the discharge processing so that the developing unit does not form the second band-like toner image when time corresponding to one rotation of the transfer roller elapses from a time when the first band-like toner image is formed.

* * * * *